United States Patent [19]

Linares et al.

[11] 4,175,950

[45] Nov. 27, 1979

[54] PREPARATION OF PHOSPHORUS CONTAINING METALLIC GLASS FORMING ALLOY MELTS

[75] Inventors: Robert C. Linares, Warren; Wiktor Ambasz, Metuchen, both of N.J.

[73] Assignee: Allied Chemical Corporation, Morris Township, Morris County, N.J.

[21] Appl. No.: 925,579

[22] Filed: Jul. 17, 1978

[51] Int. Cl.[2] ..... C22B 9/10

[52] U.S. Cl. ..... 75/53; 75/82; 75/257

[58] Field of Search ..... 75/53–58, 75/257, 82

[56] References Cited

U.S. PATENT DOCUMENTS

| | | | |
|---|---|---|---|
| 2,654,670 | 10/1953 | Davis | 75/257 |
| 3,669,647 | 6/1972 | Barbour | 75/257 |
| 3,809,547 | 5/1974 | Lewis | 75/53 |
| 3,827,880 | 8/1974 | Greeson | 75/53 |
| 3,976,474 | 8/1976 | Wunder | 75/257 |
| 4,078,915 | 5/1978 | Meichsner | 75/53 |

*Primary Examiner*—P. D. Rosenberg
*Attorney, Agent, or Firm*—H. M. Kasper; G. H. Fuchs

[57] ABSTRACT

Phosphorus rich transition metal alloys are protected by a layer of boron oxide during the melting process. The presence of the boron oxide layer prevents the evaporation of phosphorus values.

7 Claims, No Drawings

PREPARATION OF PHOSPHORUS CONTAINING METALLIC GLASS FORMING ALLOY MELTS

BACKGROUND OF THE INVENTION

Preparation of phosphide based melts of glass forming metallic alloys under ambient atmosphere leads to oxide inclusions in the glass. The conventional method of excluding the ambient atmosphere by vacuum melting leads to possible losses of phosphorus values from the melt due to evaporation.

Iron phosphide is a basic ingredient in many glass-forming metallic alloy compositions, and in the high purity form required for such purpose, it is quite costly. Inexpensive forms of iron phosphide available are impure and contain phosphorus in form which can evaporate upon heating, and which tends to form volatile phosphorous peroxide and which poses a safety hazard and results in changes of the alloy composition.

It is a purpose of the present invention to prevent oxidation of glass forming alloys in melt form.

It is another purpose of the present invention to dissolve and thereby remove oxide scum forming on the surface of liquid glass forming alloy melts.

It is a further purpose of the present invention to prevent loss of phosphorous values from melts of phosphorous-containing alloys.

SUMMARY OF THE INVENTION

Phosphorous-containing metallic glass forming alloy melts are covered with a layer of molten boron oxide flux. Such layer protects the melt from oxidation, dissolves oxide particulates and impurities from the molten metal alloy and prevents the evaporation of phosphorus values. The flux floating on the alloy melt will not interfere with subsequent casting or spinning operations, and the alloy melt can be replenished directly through the glass layer. Alloys prepared according to the process of the present invention leave minimum residues in the jetting crucible in subsequent spincasting operations of the type to which glass forming alloys are usually subjected.

DETAILED DESCRIPTION OF THE INVENTION

Metallic glass forming alloys useful in the present invention contain phosphorus as a metalloid component, alone or together with other metalloids, such as boron, carbon and silicon. Such alloys are disclosed in U.S. Pat. No. 3,856,513 to Chen et al., the disclosure of which is hereby incorporated by reference. The phosphorous component of such alloys is usually contributed by ingredients having the formulas $FeP_x$, $NiP_x$, $CoP_x$, $MnP_x$, wherein x is between about 0.3 and 1.1 and preferably between about 0.5 and 1.

Preferred alloy composition for use in the present invention include alloys utilizing as source of phosphorous $FeP_x$ wherein x is between about 0.5 and 1. Preferred alloy compositions include transition metal alloys containing between about 3 and 25 weight percent phosphorus. These alloys have a phosphorus partial pressure of less than 20 micron, and melting points of between about 900° C. and 1200° C.

The boron oxide fluxes of the present invention comprise compositions of the formula $B_2O_3$ of about 95 weight percent purity or better. The balance being represented by incidental impurities or intentional additives which are substantially inert, that is to say, that they do not materially interfere with the intended function of the boron oxide.

Preferred fluxes of the present invention include compositions of the formula $B_2O_3$ of better than about 98% purity.

Suitable boron oxide fluxes have a melting point between about 400° C. and 600° C. and preferably between about 400° and 500° C., and have a vapor pressure of below about 20 micron.

The boron oxide flux is employed in an amount sufficient to produce a flux layer of between about 2 and 50 mm thickness and preferably between about 5 and 10 mm thickness on top of the molten metal alloy. It is an advantage of the boron oxide flux that its solubility in the phosphorous containing glass forming alloys is low, generally less than 0.01 weight percent, based on the weight of the alloy, so that gross contamination of the alloy with the flux is avoided. Furthermore, minor contamination of the alloy with boron values is generally not deleterious, that is to say it will not adversely affect the glass forming capability of the alloy, nor its properties in the solid state.

The temperature of the alloy melt can be between about 1000° C. and 1500° C., and preferably between about 1100° C. and 1400° C. The temperature of the boron oxide flux can be between about 900° C. and 1400° C.

To prevent oxidation and loss of phosphorus value from the alloy, the boron oxide flux should be present at temperatures leading normally to oxidation and/or evaporation of phosphorus values and in particular the boron oxide should be present when the alloy is in the molten state. The boron oxide, to obtain the full benefit of its function, is desirably added to the cold change. If it is added after the alloy is melted, considerable amounts of phosphorus can be lost. To perform the function of removing oxides from the melt the flux should be soaked at temperature for a time period of at least about one minute, desirably of at least about 5 minutes, soaking times of about 5 minutes to 5 hours being eminently suitable.

Crucibles suitable for use in the practice of the present invention include those made from high temperature ceramic materials. Preferred crucibles are made from magnesia, zirconia and alumina. If desired, suitable inert atmospheres may be provided above the boron oxide flux including inert atmospheres such as argon and vacuum, although such is not essential. The pressure above the boron oxide flux is not critical, and may for example be between about 2 atmospheres and vacuum.

The rate of increasing the temperature of the filled crucible is not critical, and may, for example be between about 1000° C./hour and 2000° C./hour.

EXAMPLES 1–5

Iron, nickel, phosphorus, and boron containing glass-forming alloy compositions were prepared by melting together under vacuum raw materials of the following purity: iron, 99.9 weight percent pure; nickel, 99.9 weight percent pure; nickel boride, 99 weight percent pure having boron content of between about 17 and 19 weight percent; ferrophosphorus (Type I) containing 61.43 weight percent iron and 20.39 weight percent boron; ferrophosphorus (Type II) containing 79 weight percent iron and 21 weight percent phosphorus. To each charge there was added an amount of $Fe_{40}$-

$Ni_{40}P_{14}B_6$ (atomic percent) metal alloy to provide an initial susceptor for induction heating of the charge. No $Fe_{40}Ni_{40}P_{14}B_6$ was added in case of sample 5 since the ferrophosphorus employed coupled sufficiently with the radiation. The charge was contained in a magnesia crucible covered with boron trioxide and heated by means of induction heating coils. The melt of Example 1, 2, 4, 5 was maintained under vacuum under a layer of $B_2O_3$ flux at a temperature of 1200° C. for one hour, before casting it into ingots. The melt of Example 3 was soaked at 1300° C. for 1 hour. The amounts of materials charged are summarized in Table I below:

Table I

| | Charge (grams) | | | | | |
|---|---|---|---|---|---|---|
| Example | Ferro-phosphorus | $Fe_{40}Ni_{40}P_{14}B_6$ alloy | Fe | Ni | NiB | $B_2O_3$ |
| 1 | 915 (I) | 400 | 263 | 895 | 193 | 136 |
| 2 | 1200 (I) | | | | | 1030 |
| 3 | 823 (I) | 707 | 358 | 895 | 199 | 154 |
| 4 | 4937 (I) | 2265 | 2151 | 5370 | 1100 | 300 |
| 5 | 3818 (II) | | 898 | 3654 | 773 | |

The cast ingots were subjected to analysis for insolubles, oxygen, silicon, calcium, iron, nickel, phosphorus, and boron. The ingot obtained in Example 3 was further subjected to a second melt cycle at 1200° C. for 1 hour in vacuum under a flux of $B_2O_3$. The remelted alloy was again cast into an ingot and subjected to analysis. The results of the analysis are shown in Table II below.

Iron, nickel, boron and phosphorus were determined by wet chemistry; oxygen was determined by placing pieces of raw alloy in a graphite boat in a Leco oxygen analyzer. This method determines only dissolved oxygen, but not chemically bonded oxygen. The procedure for determining insolubles involved dissolving a 2 gram sample of the solid ingot in 100 milliliter of a reagent solution composed of 50 milliliter nitric acid (70% $HNO_3$); 10 milliliter of sulfuric acid (100% $H_2SO_4$) and 40 milliliter of water. The alloy was refluxed in the reagent solution until dissolved. The resultant solution was filtered through a analytical filter to determine insoluble content as ash residue. Silicon and calcium were determined by taking an aliquot part of the solution, evaporating the solution, mixing the residue with spectrographic grade graphite and determining the traces by emissions spectroscopy.

Table 2

| | | Analytical Results Weight Percent | | | | | | |
|---|---|---|---|---|---|---|---|---|
| SAMPLE | Insoluble Test | Oxygen | Si | Ca | Fe | Ni | P | B |
| 1 | 1.29 | 0.031 | 0.05 | less than 0.03 | 40.14 | 49.51 | 9.82 | 0.79 |
| 3 | 0.65 | 0.14 | 0.03 | less than 0.01 | 41.99 | 47.64 | 9.19 | 1.18 |
| 4 | 1.1 | 0.17 | 0.51 | less than 0.05 | 41.52 | 47.87 | 9.11 | 0.99 |
| 5 | 0.03 | 0.01 | 0.03 | less than 0.03 | 44.21 | 45.52 | 8.93 | 1.35 |

We claim:

1. In the process of melting phosphorus-containing glass forming transition metal alloys the improvement which comprises covering the exposed surface of said metal alloy with a layer of a molten flux composition comprising boron trioxide of at least about 95 weight percent purity.

2. The improvement of claim 1 wherein said alloy has a phosphorus content of between about 3 weight percent and about 25 weight percent.

3. The improvement of claim 1 wherein the metal alloy is in a molten state.

4. The improvement of claim 3 wherein said flux in contact with the melt is at a temperature within the range of about 900° C. and 1400° C.

5. The improvement of claim 1 wherein the flux composition is employed in amount sufficient to provide a flux layer of between about 2 and 50 mm thickness.

6. The improvement of claim 1 wherein the phosphorus is supplied to the melt in the form of ferrophosphorus.

7. The improvement of claim 1 wherein the molten metal alloy additionally contains boron.

* * * * *